US005328205A

United States Patent [19]

Bacharach

[11] Patent Number: 5,328,205

[45] Date of Patent: Jul. 12, 1994

[54] COMBINATION SKI POLE AND HAND STRAP

[76] Inventor: David W. Bacharach, 2643 Marquette Dr., St. Cloud, Minn. 56301

[21] Appl. No.: 105,604

[22] Filed: Aug. 12, 1993

[51] Int. Cl.[5] ..... A63C 11/00

[52] U.S. Cl. ..... 280/822; 135/72; 2/160; 2/161.1; 2/917

[58] Field of Search ..... 280/821, 809, 822, 816; 2/160, 161 A, 162; 135/72, 65, 76; 294/25

[56] References Cited

U.S. PATENT DOCUMENTS 5,092,629 3/1992 Bagneres et al. ..... 280/821

5,110,154 5/1992 Street ..... 280/822

*Primary Examiner*—Richard M. Camby

*Attorney, Agent, or Firm*—Haugen and Nikolai

[57] ABSTRACT

A combination ski pole grip, and a form-fitting hand strap which can be comfortably worn by a skier and selectively secured to a pole grip for use in all alpine and nordic skiing and competition. The hand strap comprises a wrist band and a palm strap which traverses across the skier's palm and which is wider proximate the wrist band than a midsection disposed between the thumb and index finger. The wrist band forms an inverted V-shape over the palm and above the wrist such that the hand strap provides the thumb and wrist with a full range of motion, does not migrate up the hand, cannot rotate about the skier's wrist, provides better application of poling force, and generates no pressure points on the hand and wrist. The palm strap includes a securing mechanism, as does the pole grip, such that the hand strap can be quickly and easily detached and reattached from the pole grip at any time the skier chooses. Further, the wrist band and palm strap are provided with adjustment features such that the hand strap can be comfortably adapted to conform to a particular skier's hand.

18 Claims, 3 Drawing Sheets

COMBINATION SKI POLE AND HAND STRAP

FIELD OF THE INVENTION

This invention relates generally to skiing equipment, and more particularly to a combination ski pole grip and hand strap whereby the skier can quickly and easily attach and detach the hand strap from the ski pole, and wherein migration of the hand strap up the hand and around the wrist is inhibited.

BACKGROUND OF THE INVENTION

In most skiing, both alpine and cross-country, the skier should be able to quickly and easily detach and reattach his hands to the ski poles. Poles must be able to be removed prior to riding a ski lift, when a ski pole's basket is caught behind the skier, when stopping and/or during a severe fall. Conventional ski pole grips and straps generally do not address these concerns.

Conventional ski poles typically include a hand grip with loop-type straps attached thereabove through which the skier can insert his hand so that the strap effectively wraps around the wrist while grasping the hand grip. Other alpine grips include grips without loops. Rather, a molded rubber or plastic platform with short extensions allow for the hand to grip the pole without the traditional loop around the wrist. This strapless grip is reported to be safer than grips incorporating a loop strap, however, strapless grips predispose the thumb for injury during a fall when the pole does not come off the hand.

Still yet another type is a system that joins a glove and pole into a single functional unit. Although these systems are novel in their approach, they suffer from inadequate release mechanisms and/or poorly functioning strap systems.

For example, the system disclosed by Bagneres et al. in U.S. Pat. No. 5,092,629 could easily develop irritations along the fifth metacarpal, as well as preventing or losing poling forces during ulnar flexion (a common action during the follow through of most poling actions). It is also unclear as to how the tongue and fixation means described therein can prevent premature release during a downward shock, while still allowing release in an upward and/or outwardly directed shock or movement.

Another example of prior art that falls short of the currently proposed system is that of Street, disclosed in U.S. Pat. No. 5,110,154. The ski pole and glove disclosed in the Street patent does not provide a release mechanism to provide for accidental release. Additionally, the wrist strap taught by Street does not prevent bunching of the glove on the skier's palmar surface.

Other deficiencies of conventional ski pole grips with a loop strap includes discomfort and injury which can occur during prolonged and extensive use. Further, conventional straps can frequently migrate around the wrist, and up the skier's hand which restricts the range of motion of the skier's thumb. Moreover, conventional ski pole straps can create pressure points on the hand and wrist which fatigues and creates discomfort to the skier's hand. Frequently, conventional pole straps need to be repositioned around the wrist which can interrupt the skier's technique and for ski racers decrease skiing velocity.

OBJECTS

It is a principle purpose of the present invention to provide a ski pole grip and hand strap combination which allows rapid coupling and uncoupling of the skier's hand to and from a ski pole hand grip wherein the hand strap is designed to eliminate pressure points on a hand and wrist.

A further object of the present invention is to provide a well designed hand strap which allows the skier's thumb full range of motion, provides better application of poling forces, and inhibits migration of the hand strap up the skier's hand.

Still yet a further object of the present invention is to provide a custom designed hand strap which cannot rotate about the skier's wrist, and wherein the strap is comfortably received within the skier's palm.

SUMMARY OF THE INVENTION

The foregoing features and advantages of the present invention are achieved by providing a ski pole having a palm strap extending across the skier's palm and between the thumb and index finger, wherein the strap is wider proximate the wrist than between the thumb and index finger. A wrist band connected to the palm strap defines an inverted V-shape over the palm and above the wrist which helps eliminate pressure points on the wrist or fingers. Thus, the hand strap is comfortably adapted to the skier's hand, and cannot migrate up the hand, or about the wrist during use.

Specifically, the invention comprises, in combination, a ski pole having a ground engaging member at one end and a hand grip proximate the other end. The hand grip has a forward surface area and a first fastening mechanism disposed at a rear surface area which is located generally 180 degrees opposite the forward surface area. A wrist band which is adapted to be disposed around the skier's wrist includes an elongated palm strap fastened at a first and second end to the wrist band. The palm strap is adapted to extend from the first end and traverse a palm of the skier at a predetermined angle to a midsection disposed between the skier's thumb and index finger, and then across a back of the skier's hand to the wrist band at the second end. The strap is characterized as being substantially wider proximate the first end at the wrist band than at the midsection, which midsection is adapted to extend between the skier's thumb and index finger. The strap further includes a second fastening mechanism disposed proximate the midsection thereof for selectively securing the strap to the ski pole first fastening mechanism. Since the strap is wider proximate the wrist band and tapers to a narrower portion between the thumb and index finger, the strap is comfortably traversed across the skier's palm along the life-line, and cannot migrate up the hand during use. Further the wrist band is inhibited from rotating about the skier's wrist. Moreover, pressure points on a hand and wrist are avoided and the thumb has a full range of motion, and a better application of poling forces can be applied by the skier's hand precisely down the pole.

In the preferred embodiment of the invention, the wrist band is characterized as extending each side of the palm strap first end to define a pair of obtuse angles in relation to the strap such that the wrist band forms an inverted V-shape below the skier's palm. This unique inverted V-shape wrist band defined beneath the skier's palm further facilitates providing a full range of motion for the first metacarpal or thumb, and does not create any pressure on the fifth metacarpal. Moreover, the shape inhibits possible rotation of the wrist band about the skier's wrist during leisure skiing or competition. The wrist band preferably has a first and second end, each having a third fastening mechanism, for selectively securing the wrist band first and second ends together to form a loop. Thus, the wrist band can be easily attached to and removed from the hand, and further, allows the wrist band and strap to be form-fit to the skier's hand. Preferably, the wrist band first and second ends are defined proximate the palm strap second end along the backside of the skier's hand, where the fastening means is comprised of VELCRO® hook-in-loop material. Further, a portion of the palm strap extending between the midsection and the second end is preferably comprised of an elastic material to further facilitate a custom fit to the competitor's hand.

In the preferred embodiment, the ski pole first fastening mechanism is preferably comprised of a recess defined in the pole grip rear surface with a pin disposed therein and extending thereacross. The palm strap second fastening mechanism comprises a clip member with a slot wherein the grip recess is adapted to receive the clip member, and the clip member slot is adapted to frictionally receive the grip pin. This clip member can be easily disposed within the slot and secured due to the frictional engagement of the slot and pin. The clip member can be quickly removed therefrom by pulling the hand backward and/or upward in relation to the ski pole so that the clip member will be released from the grip pin. In the preferred embodiment, the pin traverses across an upper portion of the recess, and the clip member slot opens generally upwardly.

In an alternate preferred embodiment of the invention the pin traverses across a midsection of the recess, and the clip member slot opens generally inward at a midsection thereof to securingly receive the pin in a snap fit. The recess closely conforms to the parameter of the clip at a lower portion thereof, but is deeper and spaced away from the upper portion of the clip such that the clip can be pivoted in the clockwise direction while remaining secured to the pin. This clip member and pin arrangement is ideally suited for cross country skiing for it allows a greater range of poling forces without release. When the clip member is rotated to a predetermined angle the upper portion of the clip will wedge against the bottom of the grip recess to facilitate release therefrom. While these clip members and recesses are the preferred embodiments, other fastening arrangements such as the teachings of the Street U.S. Pat. No. 5,110,154 are envisioned, and limitation to these embodiments is not to be inferred.

Further features and advantages of the invention will become apparent to those skilled in the art from the following detailed description of a preferred embodiment, especially when considered in conjunction with the accompanying drawings in which like numerals in the several views referred to corresponding parts.

DESCRIPTION OF THE PREFERRED EMBODIMENT

Figure 1:
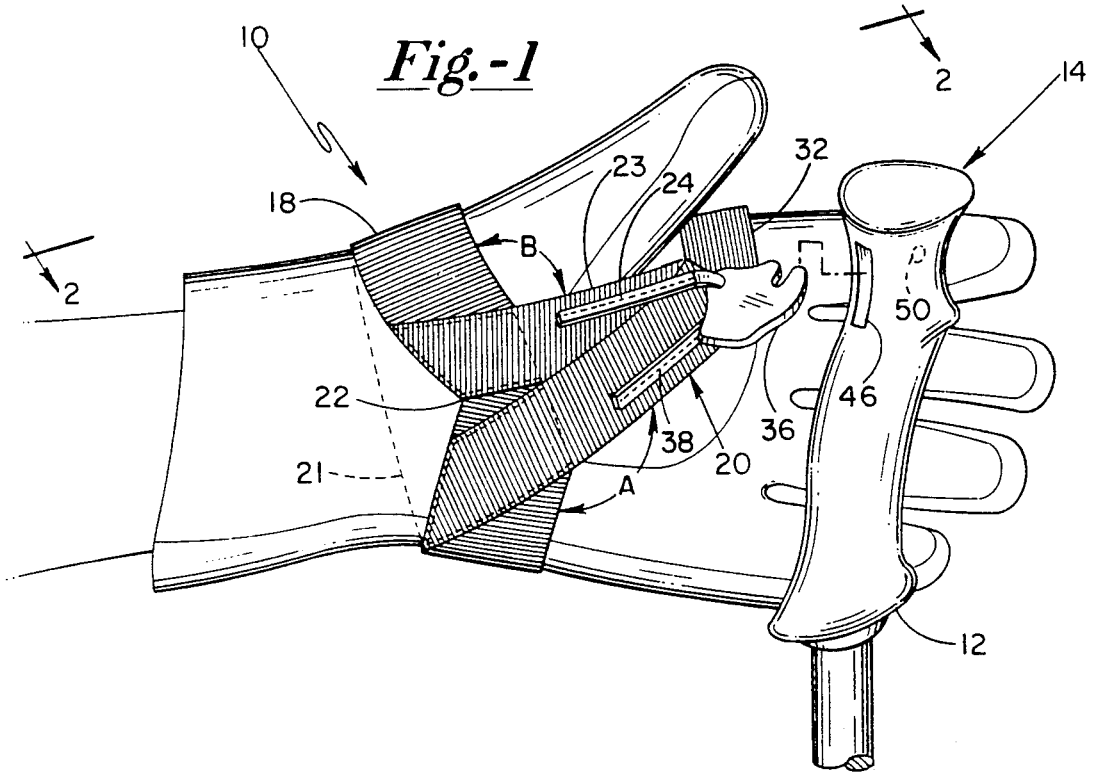
FIG. 1 is a side elevational view of a ski pole and hand strap adapted to a skier's hand illustrating the wider portion of the strap traversing the palm, wherein the wrist band defines an inverted V-shape over the palm to provide wrist clearance.

Referring now to FIG. 1, there is indicated generally at 10 a hand strap adapted to a skier's hand and secured to the hand grip 12 of a ski pole 14. Hand strap 10 is comprised of a wrist band 18 and a palm strap 20 which is secured to wrist band 18 at two locations and traverses across the skier's palm and between the thumb and index finger at a predetermined angle along the life-line of the palm. Palm strap 20 in combination with wrist band 18 defines a pair of openings, one for receiving the skier's thumb, and a second for receiving the other four metacarpals. Palm strap 20 is characterized as being wider proximate wrist band 18 than where it extends between the skier's thumb and index finger. Thus, palm strap 20 comfortably covers a substantial portion of the skier's palm such that palm strap 20 does not have any play to shift across the skier's palm.

Further shown in FIG. 1 is the unique design of wrist band 18 as forming an inverted V-shape over a center of the skier's palm, and above the wrist indicated by the dotted lines generally at 21. This V-shape provides a large clearance for both the skier's wrist and thumb to give the thumb full range of motion, which may decrease thumb injuries and does not create any pressure on the fifth metacarpal of the skier's hand. Further, the combination wrist band 18 and palm strap 20 is custom fit to the skier's hand to minimize any pressure points of the hand and wrist. Moreover, the unique combination of the wrist band 18 and palm strap 20 provides for better application of poling forces by the hand, wherein poling forces will be directed precisely down the shaft, and wherein the wrist band cannot migrate up the hand like traditional straps known in the prior art.

The inverted V-shape wrist band 18 is characterized as defining a pair of obtuse angles labeled A and B as shown in FIG. 1. Palm strap 20 is further characterized as including a pair of straps 23 each secured to the wrist band 18 at opposite sides of an apex 22 and which taper together and are secured together, such as by stitching, at a narrow portion identified at 24 which is disposed between the skier's thumb and index finger. This portion 24 is generally the midsection of palm strap 20. The symmetric design of the pair of straps 23 allows the skier to easily "cup" the palm about a vertical center line of the palm while holding pole 14. However, the pair of straps 23 could be substituted by a single strap tapering in width from narrow portion 24 to a wide portion proximate wrist strap 18, and limitation to a pair of straps 23 forming the tapering palm portion of palm strap 20 is not to be inferred.

Figure 2:
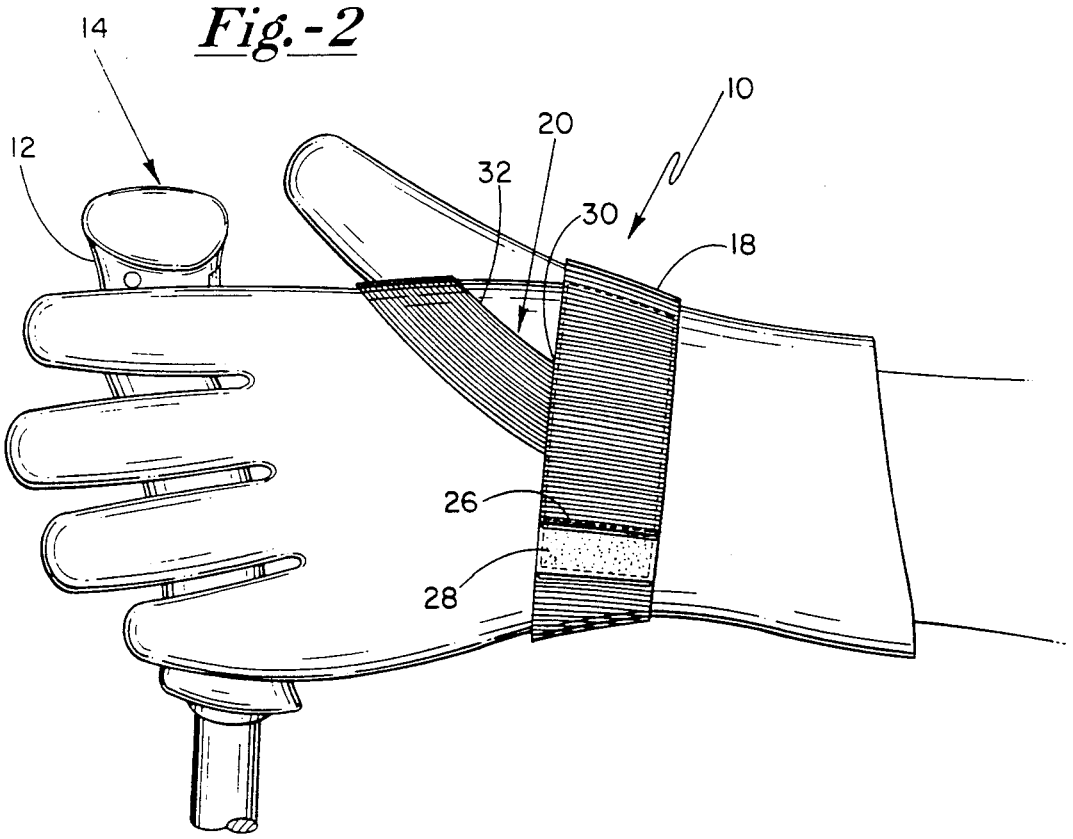
FIG. 2 is a back elevational view of the hand 2—2 shown in FIG. 1 illustrating an elastic section of the palm strap traversing across the back of the skier's hand and secured to the wrist band, wherein the wrist band has a first and second end securable to one another with VELCRO®.

Referring now to FIG. 2, a back elevational view 2—2 shown in FIG. 1 is illustrated to show palm strap 20 extending across the back of the skier's hand at a predetermined angle and which is secured to the wrist band, such as by stitching, proximate the wrist. Also shown in FIG. 2 is wrist band 18 having a first end 26, and a second end which is overlapped by end 26 (not shown), wherein both first end 26 and the second end include VELCRO® portions indicated at 28 for allowing the first end 26 and the second end to be secured to one another and comfortably around the skier's wrist. Preferably, the portion of palm strap 20 extending from the midsection portion 24 to the second end identified at 30 and which is secured to wrist band 18 by stitching, is comprised of an elastic portion 32. The VELCRO® portions allow the skier to perform two important functions. One, to comfortably adjust the wrist band 18 and palm strap 20 to the skier's hand in combination with elastic portion 32. Two, it allows the skier to select the placement of strap midsection 24, which is clip member 36 flexibly connected thereto (see FIGS. 4 and 5), such that the palm strap 20 can be selectively fitted on the pole grip 12 to hold it in place. This adjustment feature of where palm strap midsection 24 is positioned in relation to the skier's palm eliminates the need to grip the pole grip 12 thus reducing muscular fatigue of the forearm flexor muscles.

The overall hand strap 10 including the inverted V-shape wrist band 18 with an apex 22 disposed over the skier's palm, and the straps 23 of palm strap 20 tapering across the palm along the life-line provides an overall hand strap which can be custom adapted to conform to the skier's hand, which cannot migrate up the hand, which cannot be easily rotated about the wrist, which provides for a full range of motion of the skier's thumb, and has no pressure points on either the hand and wrist.

Figure 3:
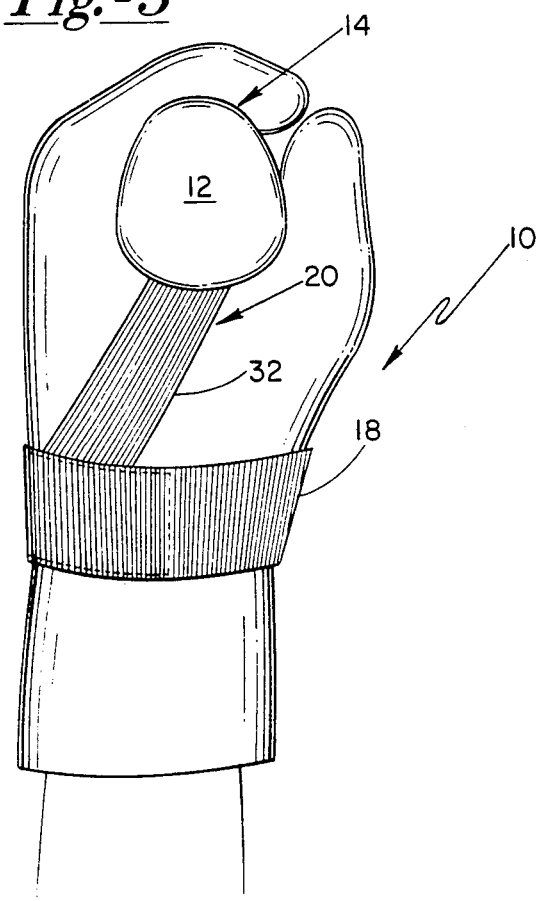
FIG. 3 is a top view 3—3 shown in FIG. 2 further illustrating the angle the strap traverses between the skier's thumb and index finger to the wrist band.

Referring to FIG. 3, a top view 3—3 shown in FIG. 2 illustrates the predetermined angle at which elastic portion 32 of palm strap 20 traverses the skier's hand from between the thumb and index finger to the wrist band 18. Elastic portion 32 has a dimension of about 1 inch in width to facilitate securingly adapting hand strap 10 to the wrist without inhibiting the full range of motion of the skier's thumb.

Figure 4:
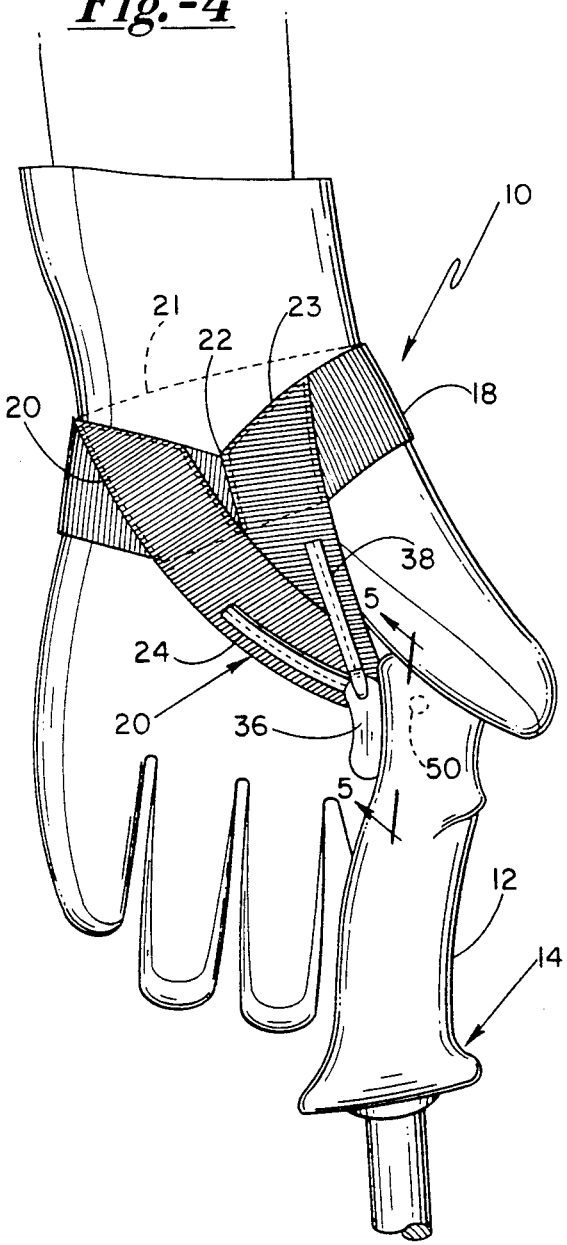
FIG. 4 is a side elevational view of the invention with the hand strap adapted to the skier's hand and secured to the pole grip, wherein the skier's hand is tilted upwardly to illustrate the strap secured to the pole grip at a selectable location between the skier's thumb and index finger.

Referring now to FIG. 4, an end view of hand strap 10 adapted to the skier's hand and secured to hand grip 12 of pole 14 is shown to illustrate how palm strap 20 is selectively secured to hand grip 12. Palm strap 20 is provided with a clip member 36 which is flexibly secured thereto at narrow portion 24 by an elongated fabric member 38 threaded through an integral opening 40 (see FIG. 5), and which fabric member 38 is secured at two locations by stitching to a respective palm strap 23 along the length thereof at portion 24. When clip 36 is selectively secured to hand grip 12, the hand has a full range of motion, including motioning the hand upwardly as shown in FIG. 4, and at the wrist since apex 22 is defined above the wrist and over the palm center.

Figure 5:
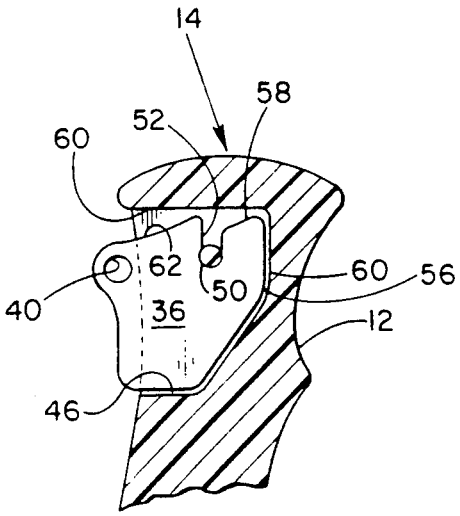
FIG. 5 is a sectional view 5—5 shown in FIG. 4 illustrating a clip member which is flexibly attached to the strap between the skier's thumb and index finger, wherein the clip member is insertable into a recess of the hand grip and includes a slot for frictionally receiving a pin disposed in and extending across the recess of the hand grip.

Referring now to FIG. 5, a recess 46 defined in a rear portion of hand grip 12 is shown which is adapted to securingly receive clip 36, and thus to secure hand strap 10 to hand grip 12. Specifically, the profile of recess 46 generally conforms to the profile shape of clip 36, wherein a rigid pin 50 is defined within recess 46 and extends transversely thereacross at an upper location thereof, as shown in FIG. 5. Clip member 36 includes a slot 52 which is wider at a lower portion thereof which conforms to the perimeter of pin 50, wherein slot 52 opens upwardly, as shown. Thus, clip member 36 can be selectively disposed within recess 46 with pin 50 disposed in slot 52, wherein clip member 36 is then pushed into recess 46 using the skier's thumb until pin 50 becomes snapped or locked within the conforming lower portion of slot 52, as shown. Clip member 36 is comprised of plastic, and a web portion 56 is defined by a finger portion 58 such that finger 58 flexes outwardly slightly to receive pin 50 in a friction fit and snap-like arrangement. Recess 46 further includes a dome-shaped portion shape 60 which generally conforms to a recess 62 of clip member 36 to further secure clip member 36 within recess 46 and to minimize play. To selectively remove clip 36 from recess 46 of hand grip 12, the skier simply tugs clip member 36 from recess 46 by urging the hand upward and/or away from grip 12 thus tugging clip member 36 at opening 40, which opening threadably receives the elongated material portion 38, shown in FIG. 4.

Figure 6:
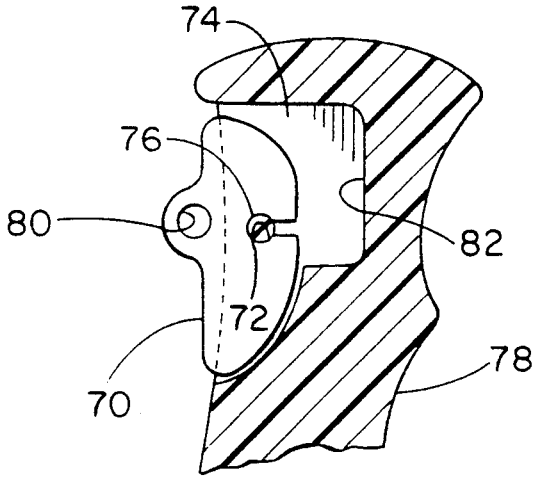
FIG. 6 is a sectional view of an alternative preferred embodiment to the clip member and pin arrangement shown in FIG. 5, wherein the recess is deeper at an upper location thereof to facilitate rotation of the clip member without release when used for cross country skiing.

Referring now to FIG. 6, an alternative preferred embodiment of a clip member and hand grip is shown. This particular embodiment is ideally suited for cross country skiing in that clip member 70 can be pivoted about a laterally extending pin 72 without being released therefrom. This arrangement allows pivoting for a range of poling without release. Pin 72 is disposed across a midsection of recess 74, which recess is deeper at an upper location thereof. Clip member 70 has a slot 76 defined in a rear midsection surface thereof which opens into recess 74. Recess 74 defined in handle 78 closely conforms to the lower inner surface of clip member 70 as shown to prevent rotation in the counterclockwise direction. An opening 80 is provided similar to opening 40 defined in clip member 36, and similarly receives elongated fabric member 38 for attachment to palm strap 20 as previously discussed. An upper inner surface 82 of recess 74 serves as a wedge to facilitate releasing clip member 70 if rotated sufficiently clockwise such that the upper end of clip member 70 is leveraged against this deeper portion of the recess. The point of wedging and release for clip member 70 can be determined by adjusting the depth of recess 74. The deeper the recess, the greater range of poling without release.

Hand grip 12 is preferably comprised of plastic, however, other sturdy materials such as aluminum would be suitable as well. Further, while clip member 36 is preferably comprised of a hardened plastic, a hardened rubber material would be suitable as well such that clip member 36 is durable, yet which allows the defined finger portion 58 to be repeatably flexed about web portion 56 to accept pin 50. Both wrist band 18 and the straps 23 of palm strap 20 which traverse the palm, as shown in FIG. 1, are preferably formed from leather or NYLON® and thus, are flexible, resilient to rotting from moisture, and are comfortable when adapted to the skier's hand, thus ensuring pressure points are not created on the skier's hand and wrist. Again, portion 32 of palm strap 20, as shown in FIG. 2, is preferably comprised of an elastic material. However, limitation to an elastic material is not to be inferred and can also be comprised of leather or nylon. Moreover, while a pair of straps 23 preferably comprise palm strap 20 proximate the skier's palm as shown in FIG. 1 and 3, a single piece of leather or nylon which is wider proximate wrist band 18 and narrower proximate midsection 24 is suitable as well, and would thus taper to a narrower portion at midsection 24 which is adapted to extend between the skier's thumb and index finger.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

I claim:

1. A device for a skier comprising, in combination:

(a) a ski pole having a ground engaging member at one end and a hand grip proximate the other end, said hand grip having a forward surface area and a first fastening means disposed at a rear surface area located generally 180° opposite said forward surface area; and (b) a wrist band adapted to be disposed around the skier's wrist, and an elongated palm strap fastened at a first and second end to said wrist band, wherein said palm strap is adapted to extend from the first end and traverse a palm of the skier at a predetermined angle to a midsection of the palm strap disposed between the skier's thumb and index finger, and then across a back of the skier's hand to said wrist band at said second end, wherein said wrist band extends each side of said palm strap first end to define a pair of obtuse angles in relation to said palm strap such that said wrist band is non-linear and forms an inverted V-shape over the skier's palm, said strap further including a second fastening means disposed proximate the midsection thereof for selectively securing said palm strap to said ski pole first fastening means.

2. The combination as specified in claim 1 wherein said palm strap is characterized as being substantially wider proximate said first end at the wrist band than at the midsection which is adapted to extend between the skier's thumb and index finger.

3. The combination as specified in claim 1 wherein said wrist band has a first and second end each including a third fastening means for selectively securing said wrist band first and second ends together to form a loop.

4. The combination as specified in claim 3 wherein said wrist band first and second ends are defined proximate said palm strap second end.

5. The combination as specified in claim 4 wherein said wrist band third fastening means is comprised of VELCRO® hook and loop material.

6. The combination as specified in claim 1 wherein a portion of said palm strap extending between said palm strap midsection and said second end is comprised of elastic material.

7. The combination as specified in claim 1 wherein said ski pole first fastening means comprises a recess defined in said grip rear surface with a pin disposed therein and extending thereacross, and said palm strap second fastening means comprises a clip member with slot wherein said grip recess is adapted to receive said clip member and said clip member slot is adapted to frictionally receive said grip pin.

8. The combination as specified in claim 7 wherein said pin traverses across an upper portion of said recess and said clip member slot opens generally upward.

9. The combination as specified in claim 7 wherein said pin traverses across a midsection of said recess and said clip member slot opens inwardly into said recess, wherein a gap is defined between an upper portion of the clip and the recess when inserted therein.

10. A device for a skier adapted to couple to a ski pole having a ground engaging member at one end and a hand grip proximate the other end, said hand grip having a forward surface area and a first fastening means disposed at a rear surface area located generally 180° opposite said forward surface area, comprising a wrist band adapted to be disposed around the skier's wrist, and an elongated palm strap fastened at a first and second end to said wrist band, wherein said palm strap is adapted to extend from the first end and traverse a palm of the skier at a predetermined angle to a midsection of the palm strap disposed between the skier's thumb and index finger, and then across a back of the skier's hand to said wrist band at said second end, wherein said wrist band is further characterized in that said wrist band extends each side of said palm strap first end to define a pair of obtuse angles in relation to said palm strap such that said wrist band is non-linear and forms an inverted V-shape over the skier's palm, said palm strap further including a second fastening means disposed proximate the midsection thereof for selectively securing said palm strap to said ski pole first fastening means.

11. The device as specified in claim 10 wherein said palm strap is characterized as substantially wider proximate said first end at the wrist band than at the midsection which is adapted to extend between the skier's thumb and index finger.

12. The device as specified in claim 11 wherein said wrist band has a first and second end each including a third fastening means for selectively securing said wrist band first and second ends together to form a loop.

13. The device as specified in claim 12 wherein said wrist band first and second ends are defined proximate said palm strap second end.

14. The device as specified in claim 13 wherein said wrist band third fastening means is comprised of VELCRO® hook and loop material.

15. The device as specified in claim 10 wherein a portion of said palm strap extending between said palm strap midsection and said second end is comprised of elastic material.

16. The device as specified in claim 10 wherein said ski pole first fastening means comprises a recess defined in said grip rear surface with a pin disposed therein and extending thereacross, and said palm strap second fastening means comprises a clip member with slot wherein said grip recess is adapted to receive said clip member and said clip member slot is adapted to frictionally receive said grip pin.

17. The device as specified in claim 16 wherein said pin traverses across an upper portion of said recess and said clip member slot opens generally upward.

18. The device as specified in claim 16 wherein said pin traverses across a midsection of said recess and said clip member slot opens inwardly into said recess, wherein a gap is defined between an upper portion of the clip and the recess when inserted therein.

* * * * *